US009097483B2

(12) United States Patent
Walterscheid

(10) Patent No.: US 9,097,483 B2
(45) **Date of Patent: *Aug. 4, 2015**

(54) TOY LAUNCHER WITH SAFETY PROJECTILES

(71) Applicant: KMA Concepts Limited, Tsim Sha Tsui, Kowloon (HK)

(72) Inventor: Steve Walterscheid, Banks, OR (US)

(73) Assignee: KMA Concepts Limited, Tsim Sha Tsui, Kowloon ( * ) Notice: Subject to any disclaimer, the term of this patent is extended or adjusted under 35 U.S.C. 154(b) by 0 days.

This patent is subject to a terminal disclaimer.

(21) Appl. No.: 13/773,615

(22) Filed: Feb. 21, 2013

(65) Prior Publication Data

US 2013/0167819 A1 Jul. 4, 2013

Related U.S. Application Data

(63) Continuation-in-part of application No. 13/225,438, filed on Sep. 3, 2011, now Pat. No. 8,485,168.

(51) Int. Cl.
*F41B 3/02* (2006.01)

(52) U.S. Cl.
CPC ..... *F41B 3/02* (2013.01)

(58) Field of Classification Search
USPC ..... 124/20.1, 20.2, 20.3
See application file for complete search history.

(56) References Cited

U.S. PATENT DOCUMENTS

| | | | | |
|---|---|---|---|---|
| 5,279,276 | A * | 1/1994 | Nagel et al. | 124/20.1 |
| 5,282,453 | A * | 2/1994 | Chia | 124/20.1 |
| 5,657,738 | A * | 8/1997 | Klundt | 124/17 |
| 6,500,042 | B1 * | 12/2002 | LaPointe | 446/64 |
| 8,485,168 | B2 * | 7/2013 | Walterscheid | 124/20.1 |

* cited by examiner

*Primary Examiner* — John Ricci
(74) *Attorney, Agent, or Firm* — LaMorte & Associates, P.C.

(57) ABSTRACT

A toy launcher and safety projectile combination, wherein the launcher only launches a safety projectile. The slingshot has a body with a first arm and a second arm that contain spring-loaded joints. A first elastomeric element extends laterally from the first arm. Likewise, a second elastomeric element extends laterally from the second arm. A safely projectile is provided. The safety projectile has a first slotted channel that is accessible through a first open end and a second slotted channel that is accessible through a second open end. The safety projectile temporarily attaches to the first elastomeric element and the second elastomeric element during launching by having the first slotted channel receive the first free end of the first elastomeric element and having the second slotted channel receive the second free end of the second elastomeric element. The safety projectile is then pulled back and released.

18 Claims, 4 Drawing Sheets

TOY LAUNCHER WITH SAFETY PROJECTILES

RELATED APPLICATIONS

This application is a continuation-in-part of U.S. patent application Ser. No. 13/225,438 filed Sep. 3, 2011.

BACKGROUND OF THE INVENTION

1. Field of the Invention

In general, the present invention relates to toy launchers, such as slingshots that are used to launch a toy projectile into flight.

2. Prior Art Description

Slingshots and similar launchers that are designed for child's play have existed throughout recorded history. In the modern era, toy slingshots typically have a plastic molded handle and an elastic string. A pocket is present on the elastic string. Objects are launched by placing the object in the pocket, pulling the pocket back against the bias of the elastic string, and releasing the pocket.

Due to the nature of its design, any slingshot, including toy slingshots, are capable of launching any object that is placed in the pocket. Although a toy slingshot may be sold with safety projectiles, a child can easily launch a small stone with equal ease. It will therefore be understood that even toy slingshots can cause injury if used in an unwise fashion.

Another problem with toy slingshots is their failure mode. If a slingshot is drawn beyond its limit, then the string of the slingshot may break. Depending upon where the breakage occurs, the broken string may fly back toward the person holding the slingshot as the stored energy is accidentally released. Since a slingshot is often held in front of the face, the whip-back of a broken string can easily cause injury to the eye.

A need therefore exists for a toy slingshot design that enables the toy slingshot only to shoot the safety projectiles that are packaged with the toy slingshot. Furthermore, a need exists for a slingshot design that eliminates the dangers of string failure to a child who may overdraw the slingshot. This need is met by the present invention as described and claimed below.

SUMMARY OF THE INVENTION

The present invention is a toy projectile launcher and safety projectile combination, wherein the launcher sets the safety projectile into flight. The toy launcher can only launch the safety projectile. The toy launcher has a body with a first arm, a second arm, and a central region that separates the first arm and the second arm. Both the first arm and the second arm contain spring-loaded joints that enable parts of both arms to twist and reorient when stressed.

A first elastomeric element extends laterally from the first arm section into the central region. The first elastomeric element has a first free end that is supported as a cantilever. Likewise, a second elastomeric element extends laterally from the second arm section into the central region. The second elastomeric element has a second free end that is also supported as a cantilever.

A safely projectile is provided. The safety projectile has a first slotted channel that is accessible through a first open end and a second slotted channel that is accessible through a second open end. The safety projectile temporarily attaches to the first elastomeric element and the second elastomeric element during launching by having the first slotted channel receive the first free end of the first elastomeric element and having the second slotted channel receive the second free end of the second elastomeric element.

The safety projectile is then pulled back and released. The needed engagement of the two slotted channels of the projectile with the two elastomeric elements of the slingshot ensure that only authorized, safety projectiles can be launched.

BRIEF DESCRIPTION OF THE DRAWINGS

For a better understanding of the present invention, reference is made to the following description of am exemplary embodiment thereof, considered in conjunction with the accompanying drawings, in which.

DETAILED DESCRIPTION OF THE DRAWINGS

Although the present invention toy launching system can be embodied in many different projectile configurations, such as a box, a crossbow, or a pistol, the exemplary embodiment selected shows a slingshot. The exemplary embodiment has been selected in order to set forth one of the best modes contemplated for the invention. The illustrated embodiment, however, is merely exemplary and should not be considered a limitation when interpreting the scope of the appended claims.

Figure 1:
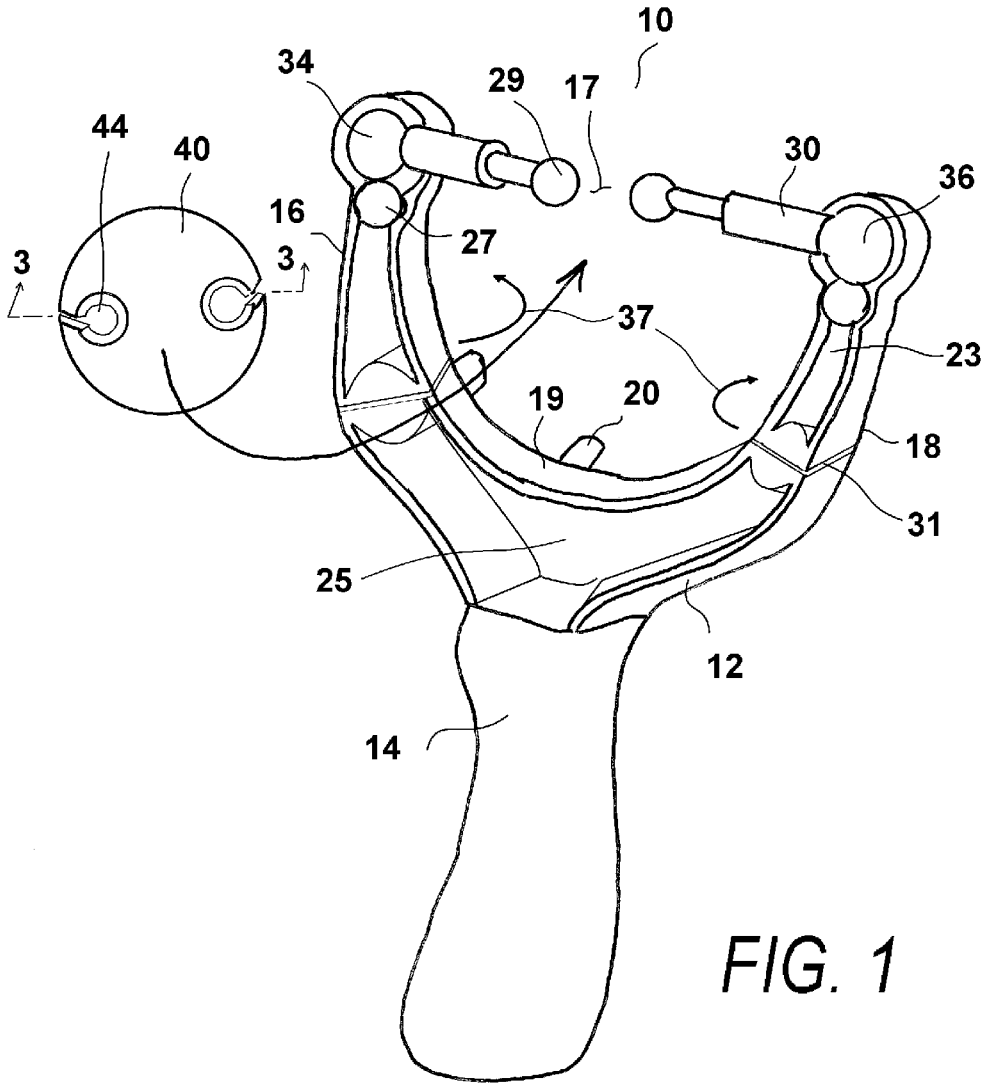
FIG. 1 is a perspective view of an exemplary embodiment of a toy slingshot launcher and safety projectile in combination.
Figure 2:
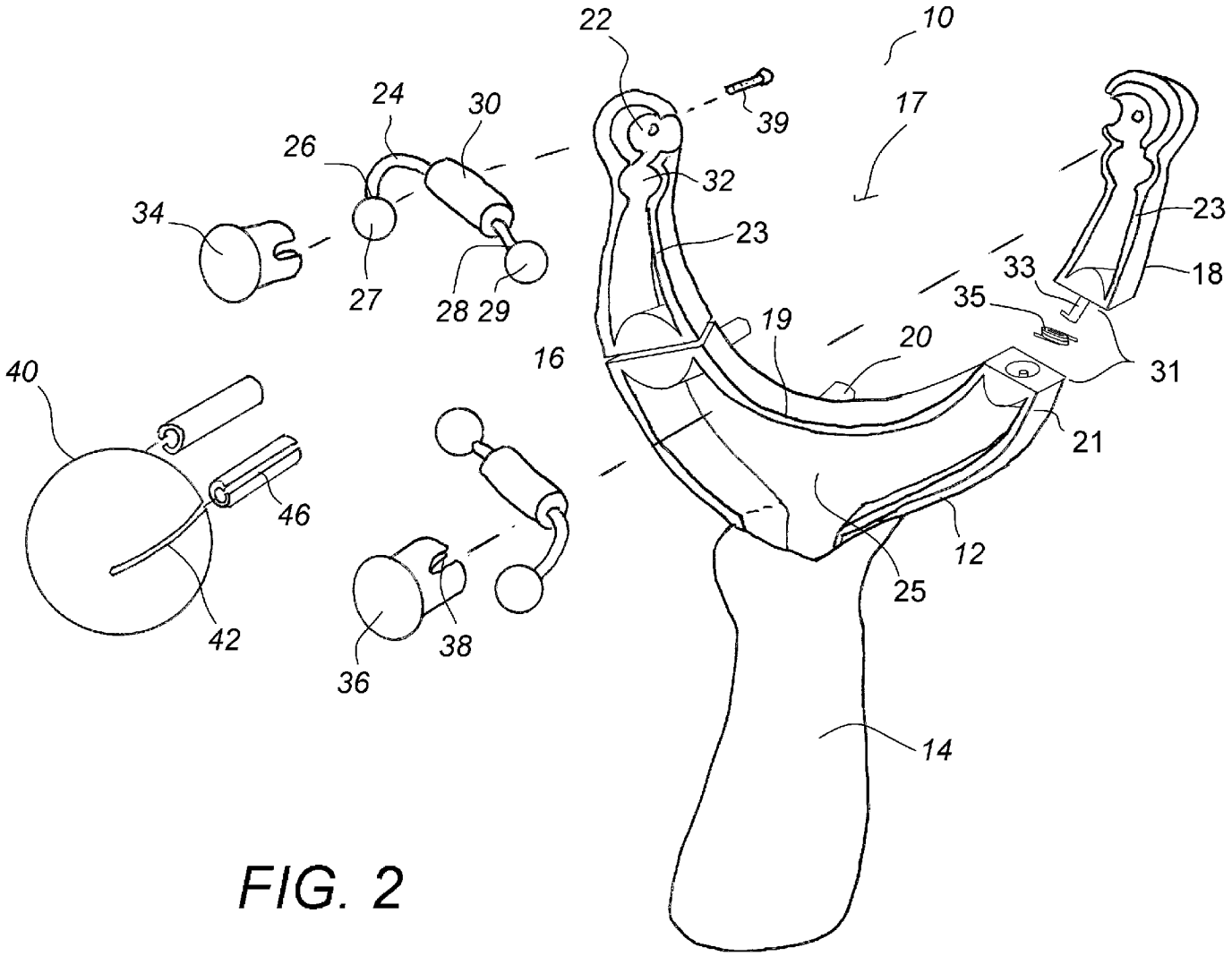
FIG. 2 is an exploded view of the embodiment of FIG. 1.

Referring to FIG. 1 in conjunction with FIG. 2, an exemplary embodiment of a slingshot launcher 10 is shown. The slingshot launcher 10 has a body 12 that is generally Y-shaped. The body 12 includes a handle 14 and two arm assemblies 16, 18 that are spaced a predetermined distance apart by a central region 17. Although the body 12 can be fabricated from wood or metal, for the mass manufacture of toys, molded plastic is preferred. To reduce mass and increase strength, the arm assemblies 16, 18 and handle 14 may be molded with reinforcement ribs 19. Furthermore, projections 20 extend outwardly from the body 12, for a purpose that will be later described.

Each of the arm assemblies 16, 18 include a lower static base 21 and an upper moving post 23. The static bases 21 of both arm assemblies 16, 18 are molded together as a single support piece 25. The support piece 25 is attached to the handle 14. Each moving post 23 is attached to the support piece 25 at a twist joint 31. A pivot pin 33 extends downwardly from the bottom of each of the moving posts 23. The pivot pins 33 engage torsion springs 35 that are mounted inside the static base 21. The torsion springs 35 apply a spring bias to the pivot pins 33 that bias the moving posts 23 into the unloaded orientation shown in FIG. 1. However, each of the moving posts 23 can be rotated in the directions of arrows 37, if they are twisted with a force that overcomes the bias of the torsion springs 35. The purpose of the twist joints 31 is later explained in detail.

The top of each moving post 23 terminates with an enlarged relief 22. The purpose of the large reliefs 22 is later explained in detail.

Two elastomeric elements 24 are provided. The elastomeric elements 24 can be solid strands of elastomeric material or segments of elastomeric tubing. Each of the elastomeric elements 24 extends straight between an anchor end 26 and a free end 28. Both the anchor end 26 and the free end 28 are terminated with an enlarged bead 27, 29 that is permanently affixed to the elastomeric element 24. The beads 27, 29 are preferably made of a hard plastic so that the beads 27, 29 do not deform when stressed by the operation of the slingshot launcher 10. Conversely, the elastomeric elements 24 are highly elastomeric and are capable of elastically expanding to at least three times their original length without tearing or breaking when stressed.

A segment of reinforcement tubing 30 is provided around each of the elastomeric elements 24. The reinforcement tubing 30 is thicker, tougher, and less elastic than the elastomeric elements 24. Although the reinforcement tubing 30 lay around sections of the elastomeric elements 24, the reinforcement tubing 30 is not bonded or otherwise attached to the material of the elastomeric elements 24.

An anchor port 32 is formed in each of the arms 16, 18 of the slingshot body 12 below the enlarged reliefs 22. The anchor ports 32 are sized to receive the anchor bead 27 at the anchor end 26 of the elastomeric elements 24. When the anchor bead 27 enters the anchor port 32, the anchor bead 27 becomes wedged in place and cannot move. This connects the anchor end 26 of each of the elastomeric elements 24 to the arms 16, 18 of the slingshot body 12.

Two plug elements 34, 36 are provided. Each of the plug elements 34, 36 defines a bottom slot 38 that turns ninety degrees. The plug elements 34, 36 pass into the enlarged reliefs 22 at the top of the arms 16, 18. The elastomeric elements 24 pass through the slots 38 in the plugs 34, 36. Consequently, the elastomeric elements 24 are bent ninety degrees as they extend through the bottom slot 38. As a result, the free end 28 of each elastomeric element 24 extends horizontally toward each other in the central region 17. As a result, both elastomeric elements 24 have free ends 28 that extend toward each other and terminate as cantilevered structures. The free end beads 29 at the ends of the elastomeric elements 24 are disposed a short distance apart.

The plug elements 34, 36 also engage one end of each segment of the reinforcement tubing 30. The segments of reinforcement tubing 30 also extend horizontally toward each other as cantilevered structures. The support provided by the reinforcement tubing 30 helps prevent the elastomeric elements 24 from sagging under the force of gravity.

The plug elements 34, 36 are attached to the enlarged reliefs 22 using either adhesive and/or a mechanical fastener, such as the shown screw 39.

Figure 3:
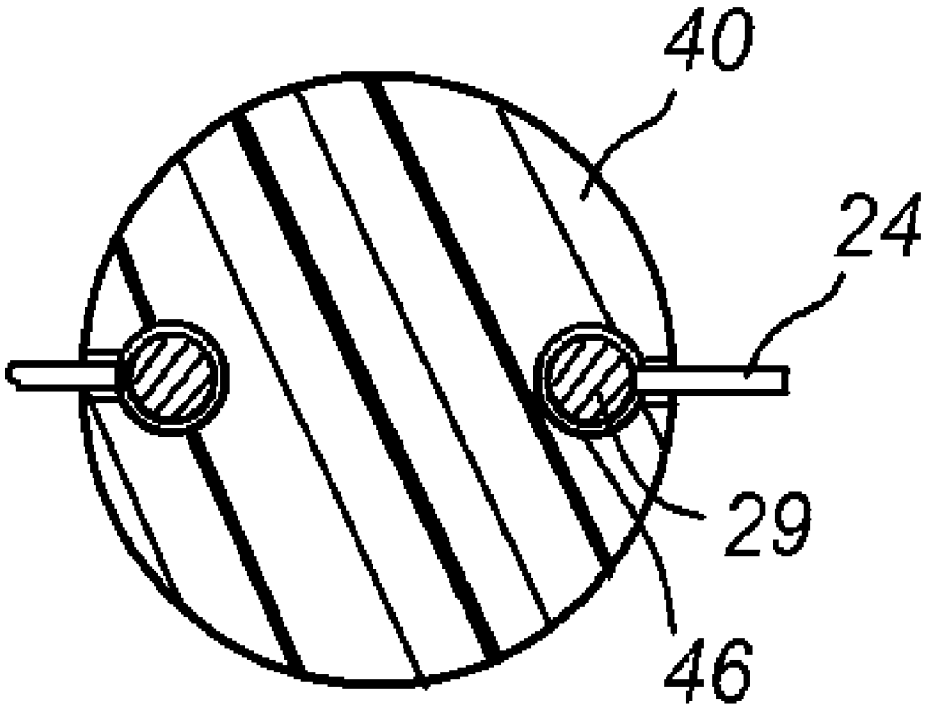
FIG. 3 is a cross-sectional view of the safety projectile of FIG. 1, viewed along section line 3-3 and shown while engaging the elastomeric elements of the slingshot launcher.

Referring to FIG. 2 in conjunction with FIG. 3, it can be seen that safety projectiles 40 are provided. Each safety projectile 40 is made from a foam rubber or similar low-density polymer formulation. In the shown embodiment, the safety projectiles 40 are spherical. However, it should be understood that other shapes, such as airplane shapes and rocket shapes can be used.

Slotted channels 42 are formed in the safety projectiles 40. Each slotted channel 42 has only one open end 44. The open ends 44 of the two slotted channels 42 are spaced a predetermined distance apart. The distance between the open ends 44 of the slotted channels 42 are exactly the same as the distance between the beads 29 at the free ends 28 of the elastomeric elements 24. It will therefore be understood that the beads 29 at the free ends 28 of the elastomeric elements 24 can easily pass into the slotted channels 42 of the safety projectile 40 through the open ends 44 of the slotted channels 42.

Each of the slotted channels 42 are lined with a slotted hard plastic insert 46. The presence of the hard plastic insert 46 prevents the hard free end beads 29 of the elastomeric elements 24 from being pulled out of the slotted channel 42 through the soft material of the safety projectile 40.

Figure 4:
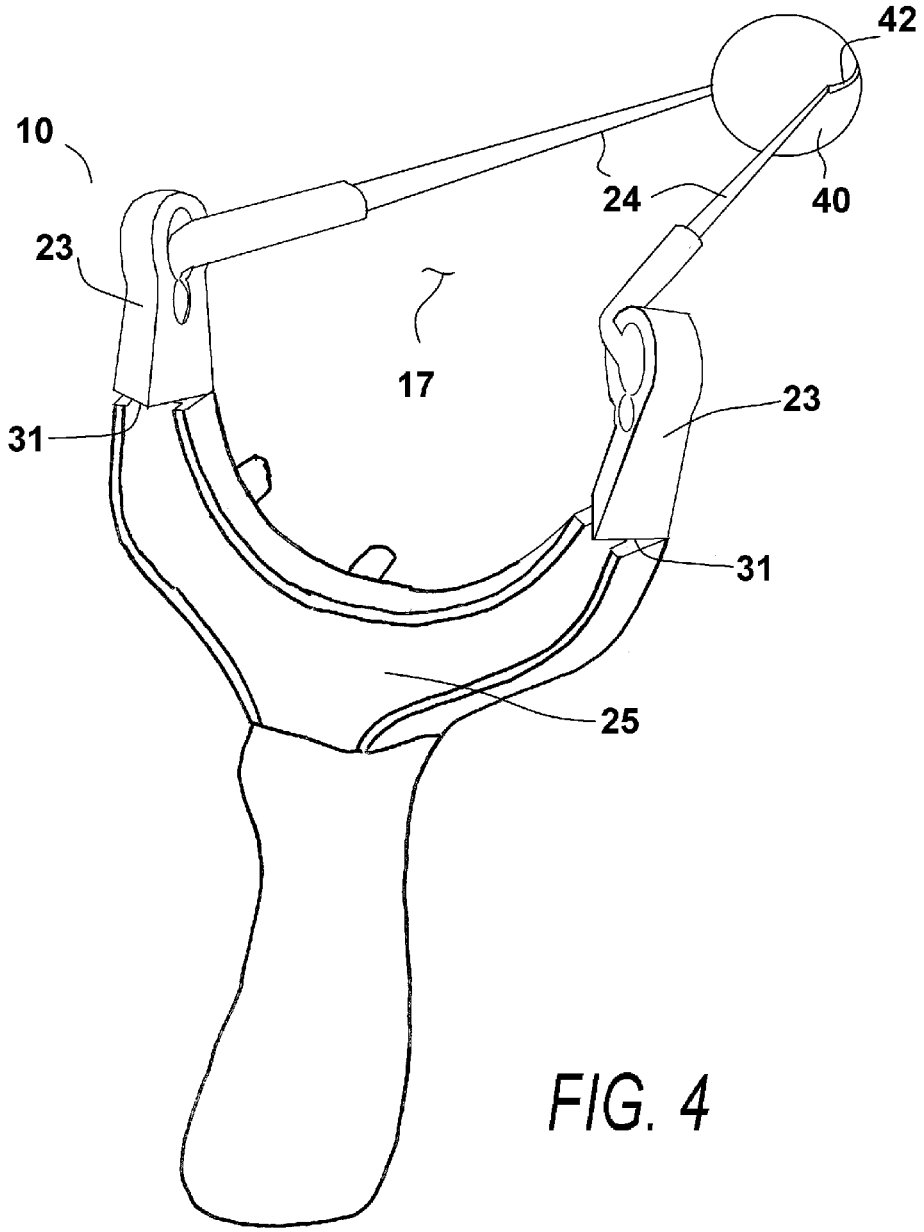
FIG. 4 shows the slingshot launcher loaded and drawn with the safety projectile.

Referring to FIG. 4 in conjunction with FIG. 2 and FIG. 3, it will be understood that in order to utilize the slingshot launcher 10, a person takes the slingshot launcher 10 and maneuvers the safety projectile 40 until the beads 29 at the free ends 28 of the elastomeric elements 24 enter the open ends 44 of the slotted channel 42 on the safety projectile 40. This interconnects the safety projectile 40 with the elastomeric elements 24 of the slingshot launcher 10. The safety projectile 40 is then manually grasped and pulled rearwardly in the horizontal plane. This causes the elastomeric elements 24 to stretch and store energy. This action also applies a torque to the moving posts 23 of the arm assemblies that acts in opposition to the bias of the torsion springs 35.

As the torque applied by the stretching of the elastomeric elements 24 overcomes the bias of the torsion springs 35, the moving posts 23 begin to turn into the orientation shown in FIG. 4. This has two effects. First, the twisting of the moving posts 23 adds the power of the torsion springs 35 to the power of the stretched elastomeric elements 24. This increases the launching power of the overall slingshot assembly 10 without increasing the stresses experienced by the elastomeric elements 24. Second, the twisting of the moving posts 23 reorients the elastomeric elements 24 so that the elastomeric elements 24 better face the direction in which they are stretched. This prevents the elastomeric elements 24 from having to experience any sharp bends as they are stretched. This greatly increases the amount of energy that can be stored in the elastomeric elements 24 without causing damage or wear to those elastomeric elements 24.

When the safety projectile 40 is released, the spring energy stored in the elastomeric elements 24 and the torsion springs 35 is simultaneously released. The slingshot launcher assembly 10 suddenly changes from the loaded configuration of FIG. 4 back to the unloaded configuration of FIG. 1. The result is that the safety projectile 40 is accelerated forward. Once the safety projectile 40 passes between the arm assemblies 16, 18 of the slingshot body 12, the free end beads 28 slide rearwardly in the slotted channels 42 and exit the slotted channels 42 through their open ends 44. At this moment, the safety projectile 40 disengages from the elastomeric elements 24 and the safety projectile 40 flies freely forward.

It will be understood that the elastomeric elements 24 of the slingshot launcher 10 can only engage a projectile that has the slotted channels 42 that are sized and spaced to receive the two beads 29 at the two free ends 28 of the elastomeric elements 24. Consequently, the present invention slingshot launcher 10 cannot launch a rock, marble, gumball, or anything else that is not specifically manufactured with the necessary slotted channels. A child having possession of the slingshot launcher 10 will therefore only be able to use the slingshot launcher 10 to launch the safety projectiles 40 provided with the slingshot launcher 10.

When the elastomeric elements 24 are stretched, they are most vulnerable to breakage. If one of the elastomeric elements 24 breaks, it is highly improbable that the second elastomeric element 24 would break at that precise moment. The unbroken elastomeric element 24 will, therefore, remain intact and will absorb much of the energy released by the broken elastomeric element. This prevents a broken elastomeric element from whipping back toward a user's face.

The slotted channels 42 within the safety projectile 40 have the same diameter as the projections 20 that extend outwardly from the slingshot body 12. This enables a projection 20 to pass into and engage the safety projectiles 40 with an interference fit. As a result, safety projectiles 40 that are not being used can be attached to the body 12 of the slingshot launcher 10 and held at the ready.

It will be understood that the embodiment of the present invention that is illustrated and described is merely exemplary and that a person skilled in the art can make many variations to that embodiment. For instance, the bow structure can have many different ornamental shapes. Likewise, the arrow projectiles can be configured as airplanes, rocket ships or any other flying projectile. All such embodiments are intended to be included within the scope of the present invention as defined by the claims.

What is claimed is:

1. A projectile launcher and safety projectile combination, wherein said projectile launcher launches said safety projectile into flight, said combination comprising:

a body having a first arm and a second arm, wherein said first arm and said second arm are separated by an open central region;

a first elastomeric element extending laterally from said first arm into said central region, wherein said first elastomeric element has a first free end;

a second elastomeric element extending laterally from said second arm into said central region, wherein said second elastomeric element has a second free end;

a safely projectile having a first slotted channel that is accessible through a first open end and a second slotted channel that is accessible through a second open end, wherein said safety projectile temporarily attaches to both said first elastomeric element and said second elastomeric element during launching by having said first slotted channel receive said first free end of said first elastomeric element and having said second slotted channel receive said second free end of said second elastomeric element.

2. The combination according to claim 1, further including joints in first arm and said second arm that enable sections of said first arm and said second arm to rotate as said first elastomeric element and said second elastomeric element are stretched when engaged with said safety projectile.

3. The combination according to claim 2, further including springs for biasing said joints into preset configurations.

4. The combination according to claim 2, wherein said first hard bead passes into said first slotted channel during launching and said second hard bead passes into said second slotted channel during launching.

5. The combination according to claim 4, further including hard plastic inserts that line said first slotted channel and said second slotted channel.

6. The combination according to claim 1, further including a first hard bead affixed to said first free end of said first elastomeric element and a second hard bead affixed to said second free end of said second elastomeric element.

7. The combination according to claim 1, further including a first reinforcement tube that surrounds a portion of said first elastomeric element and a second reinforcement tube that surrounds a portion of said second elastomeric element.

8. The combination according to claim 1, wherein said first slotted channel and said second slotted channel are aligned in parallel orientations.

9. The combination according to claim 1 wherein said first slotted channel and said second slotted channel are a predetermined distance apart and said first free end of said first elastomeric element and said second free end of said second elastomeric element are also said predetermined distance apart.

10. A toy launcher assembly, comprising:

a body having a first arm and a second arm, wherein an open central region separates said first arm and said second arm;

a first elastomeric element extending laterally from said first arm into said central region, wherein said first elastomeric element has a first free end that terminates with an enlarged head; and a second elastomeric element extending laterally from said second arm into said central region, wherein said second elastomeric element has a second free end that terminates with a second enlarged head.

11. The assembly according to claim 10, further including joints in said first arm and said second arm that enable sections of said first arm and said second arm to rotate as said first elastomeric element and said second elastomeric element are stretched.

12. The assembly according to claim 11, further including springs for biasing said joints into preset configurations.

13. The assembly according to claim 10, wherein said first elastomeric element has an anchor end, opposite said first free end, that is anchored to said first arm.

14. The assembly according to claim 10, wherein said second elastomeric element has an anchor end, opposite said second free end, that is anchored to said second arm.

15. The assembly according to claim 10, wherein said enlarged head on said first elastomeric element is a hard plastic bead affixed to said first free end of said first elastomeric element.

16. A projectile launcher assembly, comprising:

a body having a first arm and a second arm, said first arm and said second arm being separated by an open central region, wherein joints are disposed in both said first arm and said second arm that enable sections of said first arm and said second arm to rotate;

a first elastomeric element extending laterally from said first arm into said central region, wherein said first elastomeric element has a first free end; and a second elastomeric element extending laterally from said second arm into said central region, wherein said second elastomeric element has a second free end.

17. The assembly according to claim 16, further including springs for biasing said joints into preset configurations.

18. The assembly according to claim 16, further including a first hard bead affixed to said first free end of said first elastomeric element and a second hard bead affixed to said second free end of said second elastomeric element.

* * * * *